United States Patent [19]

Matsudaira et al.

[11] Patent Number: 4,799,856

[45] Date of Patent: Jan. 24, 1989

[54] VARIABLE CAPACITY RADIAL FLOW TURBINE

[75] Inventors: Nobuyasu Matsudaira; Michio Kyoya; Takashi Mikogami; Yoichiro Okazaki, all of Sagamihara; Eito Matsuo; Nobuhiro Takahira, both of Nagasaki, all of Japan

[73] Assignee: Mitsubishi Jukogyo Kabushiki Kaisha, Tokyo, Japan

[21] Appl. No.: 97,643

[22] Filed: Sep. 16, 1987

[30] Foreign Application Priority Data

Sep. 17, 1986 [JP] Japan ..... 61-142146[U]

[51] Int. Cl.[4] ..... F01D 17/16

[52] U.S. Cl. ..... 415/155; 415/164

[58] Field of Search ..... 415/148, 150, 151, 155, 415/160, 162, 163, 164, 205

[56] References Cited

U.S. PATENT DOCUMENTS

| | | | |
|---|---|---|---|
| 2,944,786 | 7/1960 | Angell et al. | 415/148 X |
| 3,313,518 | 4/1967 | Nancarrow | 415/148 X |
| 4,027,994 | 6/1977 | Macinnes | 415/205 X |
| 4,143,994 | 3/1979 | Yamaguchi | 415/205 |
| 4,519,211 | 5/1985 | Sedille et al. | 415/205 X |

FOREIGN PATENT DOCUMENTS

| | | | |
|---|---|---|---|
| 2502986 | 7/1976 | Fed. Rep. of Germany | 415/151 |
| 982583 | 6/1951 | France | 415/151 |
| 59-54705 | 3/1984 | Japan | 415/150 |
| 60-6020 | 1/1985 | Japan | 415/205 |
| 8200686 | 2/1982 | World Int. Prop. O. | 415/151 |

*Primary Examiner*—Robert E. Garrett
*Assistant Examiner*—Joseph M. Pitko
*Attorney, Agent, or Firm*—Wenderoth, Lind & Ponack

[57] ABSTRACT

A variable geometry radial turbine wherein a plurality of pivotable vanes are provided in the portion through which a gas is introduced into a turbine wheel which is disposed in a turbine housing. The pivotable vanes can be moved for the purpose of opening and closing a part of a gas introduction area whereby the gas flow rate is continuously changed.

15 Claims, 13 Drawing Sheets

VARIABLE CAPACITY RADIAL FLOW TURBINE

BACKGROUND OF THE INVENTION

1. Field of the Invention

This invention relates to various types of variable capacity type radial flow turbines for a turbocharger and so forth in which an inletting cross sectional area thereof can be changed.

2. Description of the Prior Art

The conventional type of the variable capacity turbine for a turbocharger will now be described with reference to FIGS. 12 and 13. A turbine wheel 320 is disposed in a housing 321 which forms an exhaust gas passage 327 which accelerates the exhaust gas which has been introduced. A pivotable vane 323 which is disposed in a portion 326 through which the exhaust gas is introduced into the turbine wheel 320 is opened and closed, whereby the turbine geometry is varied. In this case, as shown in FIG. 13, the passage throat area becomes $A_1$ when the pivotable vane 323 is closed, while the passage throat area becomes $A_2$ when the pivotable vane 323 is opened. As mentioned above, the throat area of the passage is changed, and this change causes the accelerating ratio to be changed, whereby the turbine capacity is changed.

Another type of the conventional variable capacity turbine is shown in FIGS. 14 and 15. In the variable inlet port type radial flow turbine, shown in FIGS. 14 and 15, the gas introduced through an inlet port of a scroll passage 400 flows through a passage 430 which is formed by a pivotable flap vane 420 and an inner wall 401 of the scroll passage, and the gas is then introduced into a rotating blade 440 through the inner side of a rear scroll passage 402.

A rotary shaft 422 which is disposed in the front edge portion 421 of the flap vane 420 projects outside through a penetrating hole 403 in the wall adjacent to the scroll passage 400. The flap vane 420 is therefore capable of being pivoted relative to the axis of the rotary shaft 422 as illustrated by the short dash line by turning a lever 423 provided with a handle of the rotary shaft 422.

By rotating the flap vane 420 relative to the axis of the rotary shaft 422, the distance between the inner wall 401 and a rear end 424 of the flap vane 420 is changed, whereby flow through area of the passage 430 is changed for the purpose of changing the flow characteristics of the turbine.

In the conventional type variable capacity turbine having a pivotable vane, shown in FIGS. 12 and 13, the amount of the exhaust gas at the time when the vane is opened and which is allowed to be introduced into the turbine wheel, and the range of amount of the gas which is between the throat area $A_2$ and the throat area $A_1$, is defined in accordance with the length of the pivotable vane 323. Therefore, the variable range of the geometry of the turbine can be made large by lengthening the pivotable vane 323, but operation of the long pivotable vane in the atmosphere of high temperature and an exhaust gas causes the durability to deteriorate. If the pivotable vane is lengthened, the angle at the time of opening and closing the vane is not changed, therefore the distance of shifting the tip of the pivotable vane becomes large in accordance with the length of the pivotable vane. The turbine performance sometimes deteriorates because the vane transverses the exhaust gas flow when the pivotable vane is opened.

The conventional type of the variable inlet port radial flow turbine shown in FIGS. 14 and 15 is a type in which the flap vane 420 is pivoted relative to the axis of the rotary shaft 422 which is disposed at the front end portion 421 of the flap vane 420 for the purpose of changing the area of the passage 430 which is formed by the rear end 424 of the flap vane 420 and the inner wall 401 of the scroll passage. Therefore, when the turbine flow rate is intended to be reduced, the rear end 424 of the flap vane 420 must be brought to near the inner wall 401 of the scroll passage. As a result of this, a dead water region is generated in the rear stream or downstream side of the flap vane 420, whereby the efficiency of the turbine rapidly deteriorates.

In the case where the flow rate of the turbine is intended to be increased in the conventional type of the variable inlet port type radial flow turbine, the rear end 424 of the flap vane 420 must be brought to a position far from the inner wall 401 of the scroll passage so as to expand the passage 430. In this case, a certain distance must be kept between the rear end 424 and the rotating blade 440 for the purpose of preventing interference. If the area of the passage 430 is intended to be increased for the purpose of increasing the maximum flow rate of the turbine with respect to the inner wall 401 of the scroll passage, the rear end 424 of the pivotable vane 420 must therefore be brought to the radially innermost position. In this case, when the flow rate is intended to be reduced, the rotational angle $\theta$ of the flap vane 420 must be further increased, whereby the dead water region which is generated at a region downstream of the flap vane 420 becomes large, as a result of which, the efficiency deteriorates.

SUMMARY OF THE INVENTION

An object of the present invention is to provide a variable capacity type radial flow turbine which can overcome the aforesaid problems and which is characterized in that the turbine geometry can be continuously varied in a wide range without any deterioration in the turbine performance and furthermore characterized in that the dead water region which is generated downstream of the pivotable blade is minimized, whereby the turbine efficiency is improved.

In order to overcome the aforesaid problems, a plurality of pivotable vane is provided in the portion through which exhaust gas is introduced into the turbine wheel which is disposed in the turbine housing for the purpose of opening and closing a part of the exhaust gas introducing portion whereby the flow rate of the exhaust gas can be continuously changed.

In the variable capacity turbine according to the present invention, a blade-shaped pivotable vane is divided into two pieces, that is, a front blade and a rear blade. The front blade with a supporting shaft disposed at the rear end portion thereof is disposed upstream, while the rear blade with a supporting shaft disposed at the front end portion thereof is disposed downstream.

Furthermore, in the radial turbine having a scroll passage, a first pivotable blade having a rotational shaft thereof disposed adjacent to the rear end with respect to the center of the blade is provided at a first radial position adjacent to the inner circumference near the entrance of the aforesaid scroll passage, and a second pivotable blade having a rotational shaft thereof disposed adjacent to the front end with respect to the center of the blade is provided at a second radial position subwardly and downstream of the first pivotable blade, the second radial position being adjacent to the outer circumference of the aforesaid scroll passage.

According to the present invention, the variable range of the area of the throat can be made large and the variable range of displacement of the turbine can be made large due to the provision of a plurality of the movable vanes.

According to another aspect of the present invention, thanks to the provision of the vane having a supporting axis which is disposed upstream and adjacent to the rear end portion thereof, the increase in flow rate can be easily realized because the passage having a radially inwardly facing opening which has been closed by the vane is opened by turning the vane. In the case where the flow rate is intended to be reduced, the vane with the supporting axis disposed downstream and at the front end portion of the blade is caused to be turned. Since the length of the vane is short, the dead water region which is generated downstream of the vane can be dept small, whereby the deterioration in efficiency can also also be kept small.

Furthermore, according to still another aspect of the present invention, since the first pivotable blade is disposed upstream in the scroll passage and at a position adjacent to the inner circumference of the passage, if the flow rate is intended to be increased, the radially inwardly facing passage which is closed by the blade is opened by way of turning this first pivotable blade.

On the other hand, if the flow rate is intended to be decreased, the passage is made narrow by turning the second pivotable blade which is disposed downstream with respect to the first pivotable blade and adjacent to the outer circumference of the scroll passage.

Figure 1:
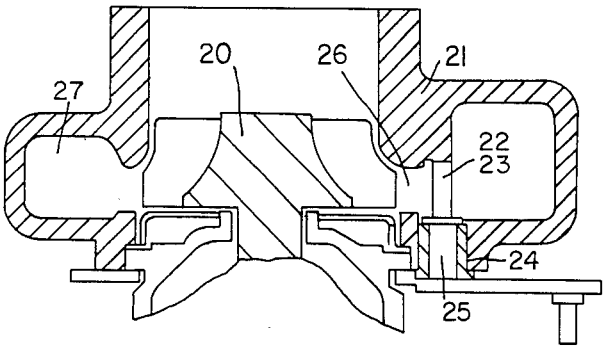
FIG. 1 is a lateral cross sectional view of a first embodiment of the present invention.
Figure 2:
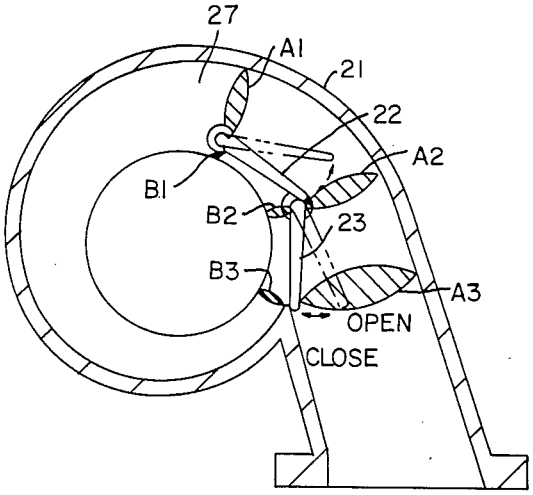
FIG. 2 is a vertical cross sectional view of the same.

PREFERRED EMBODIMENTS OF THE INVENTION:

Referring to accompanying shown in FIGS. 1 and 2, a first embodiment of the present invention will now be described.

Pivotable vanes 22 and 23 are provided in a portion 26 through which exhaust gas is introduced into a turbine wheel 20 in a turbine housing 21 and these vanes are supported by means of a bush 24. The pivotable vanes 22 and 23 are each adapted to be capable of turning relative to the axis of a respective rotatable shaft 25 which is disposed at a downstream end of each vane with respect to the flow direction of the gas. If the turbine capacity is small in this case, the surfaces of both the pivotable vanes 22 and 23 are brought into contact with a part of the portion 26 through which exhaust gas is introduced into the turbine housing 21, whereby the introduction of the exhaust gas into the turbine wheel 20 through the wall surface is prevented. As a result of this, the throat area in the exhaust gas passage 27 in the turbine housing 21, as shown in FIG. 2, becomes $A_1$. In the case where the turbine capacity is large, both of the pivotable vanes 22 and 23 move, whereby openings are formed by the movements of the vanes 22 and 23 from the contact part of the portion 26 and through said openings the exhaust gas is introduced into the turbine wheel 20. The throat area in this case is shown by $A_3$ in FIG. 2. In the case where the turbine capacity is between the aforesaid small case and the large case, only the pivotable vane 22 moves from a closed position to an open position by moving from the surface away at which it is in contact with the portion 26 whereby an opening through which the exhaust is introduced is formed. The throat area in this case is shown by $A_2$ in FIG. 2.

Figure 3A:
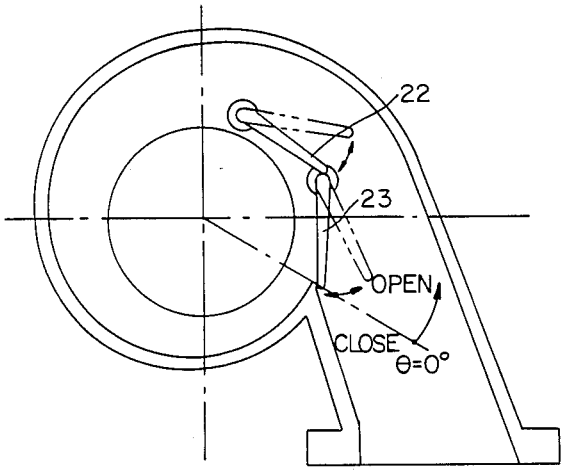
FIG. 3*a* is a vertical cross sectional view of the angle $\theta$ of the exhaust gas passage according to the same.
Figure 3B:
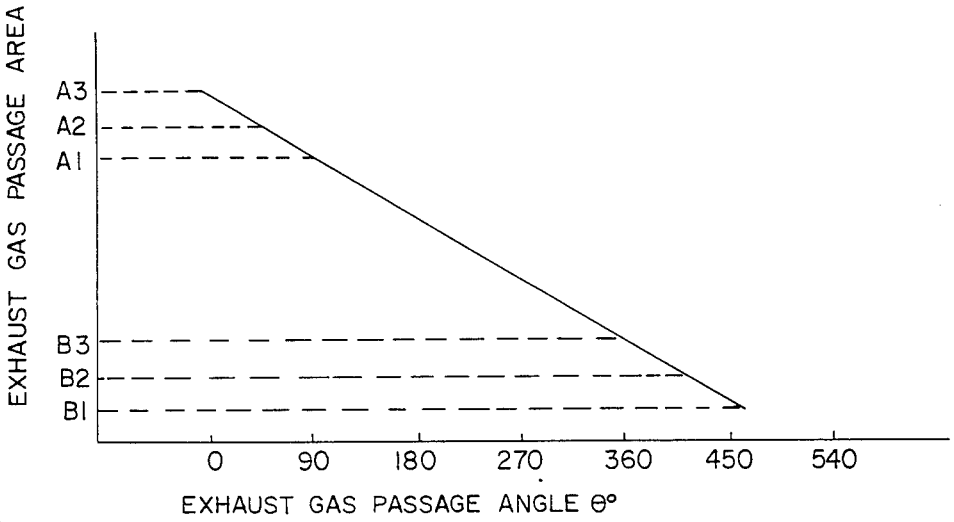
FIG. 3*b* is a graph showing the distribution of the area of the exhaust gas passage.

FIG. 3*b* is a graph showing the relationship between the passage area and exhaust gas passage angle $\theta$ around the central axis of the turbine wheel which is shown in FIG. 3*a* in accordance with the turbine capacity, large, intermediate and small. Namely, when the turbine capacity is small, the exhaust gas passage area decreases from $A_1$ to $B_1$ as the angle $\theta$ increases as designated by the arrow in FIG. 3*a*. In a similar manner, in the case where the turbine capacity is in the intermediate range, the exhaust gas passage area decreases from $A_2$ to $B_2$, and in the case where the turbine capacity is large, it decreases from $A_3$ to $B_3$ in accordance with the respective increase in the angle $\theta$. The exhaust gas passage areas $B_1$, $B_2$ and $B_3$ are shown in FIG. 2.

The foregoing embodiments are those in the case where the pivotable vanes 22 and 23 are controlled in a step manner in accordance with the turbine capacity, small, intermediate and large. The degree of opening of the pivotable vanes 22 and 23 may be defined optionally. The degree of opening of the pivotable vanes 22 and 23 may therefore be defined optionally and combined at the time of controlling for the purpose of obtaining the maximum efficiency at predetermined flow characteristics.

Although the aforementioned embodiments and drawings show the case wherein two pivotable vanes are provided, provision of three or more such vanes can display the same effect.

Figure 4:
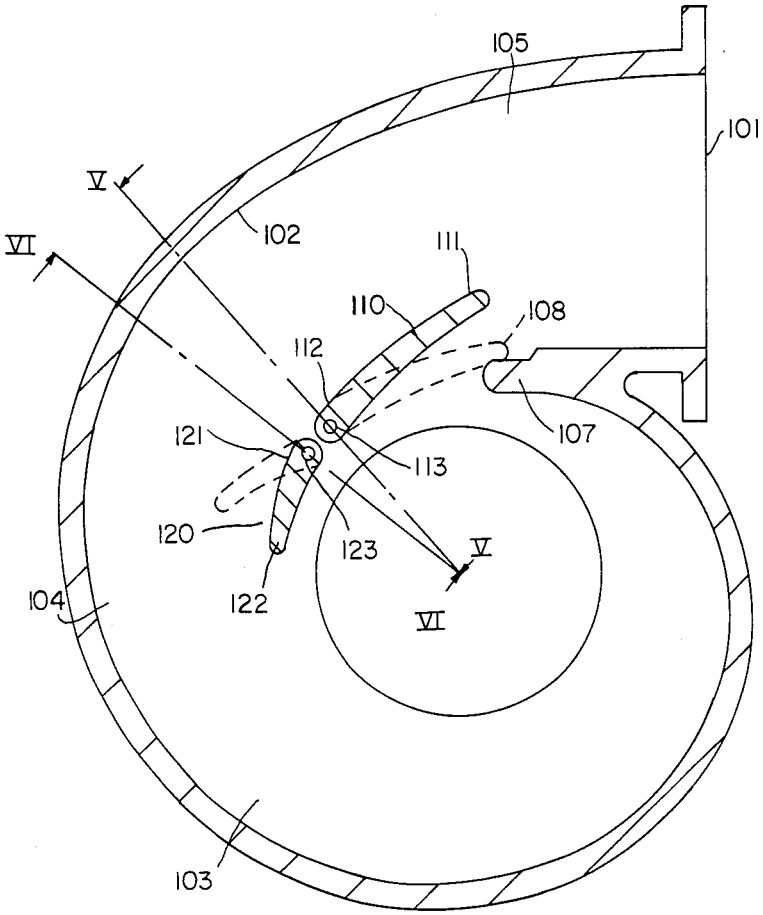
FIG. 4 is a cross sectional view of a second embodiment of the present invention.
Figure 5:
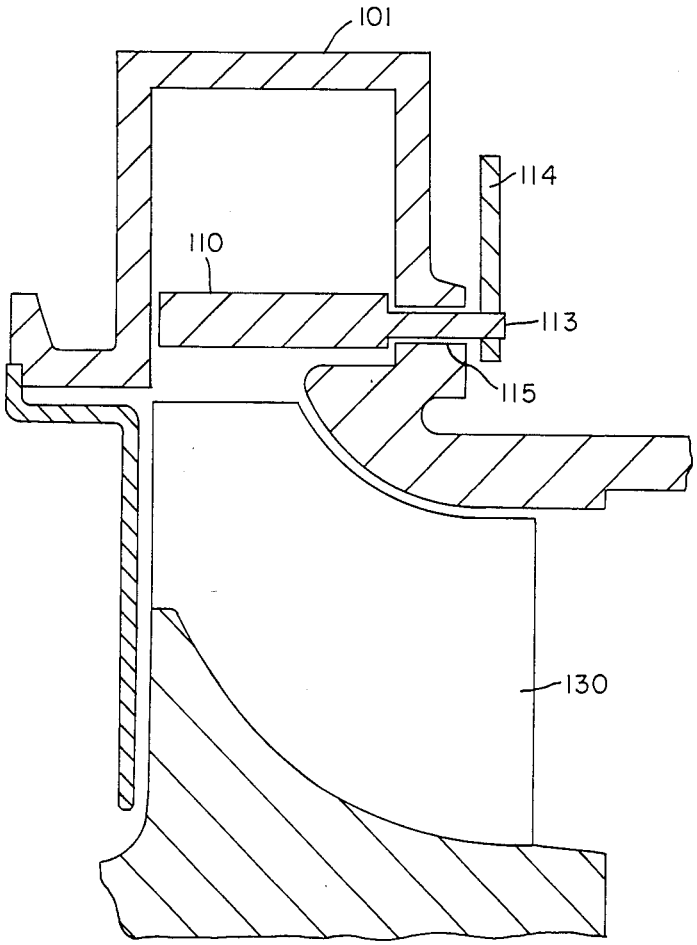
FIG. 5 is a cross sectional view taken along the line V—V in FIG. 4.
Figure 6:
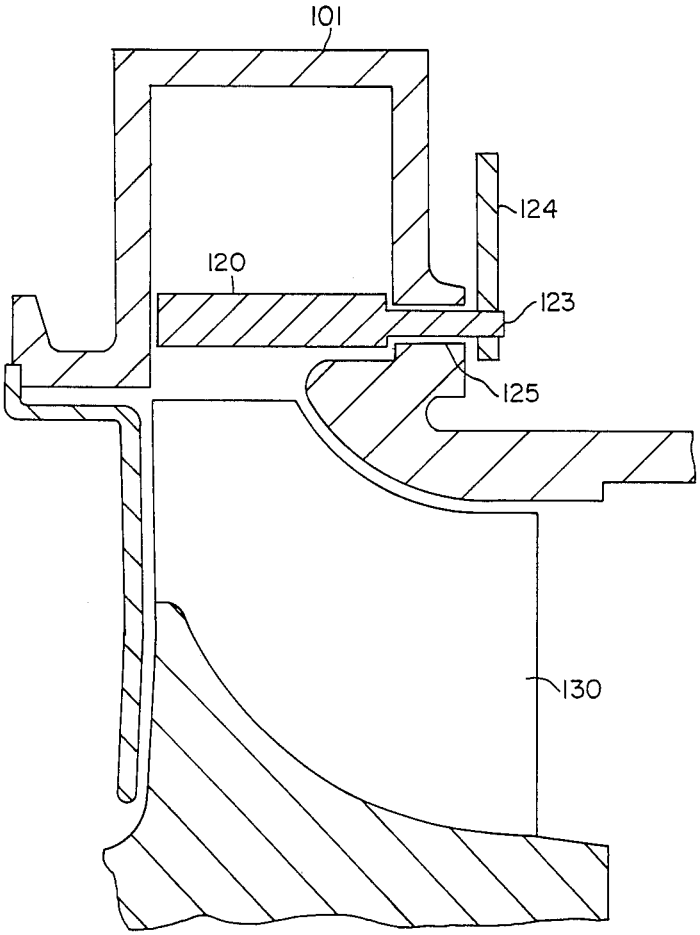
FIG. 6 is a cross sectional view taken along the line VI—VI in FIG. 4.
Figure 7:
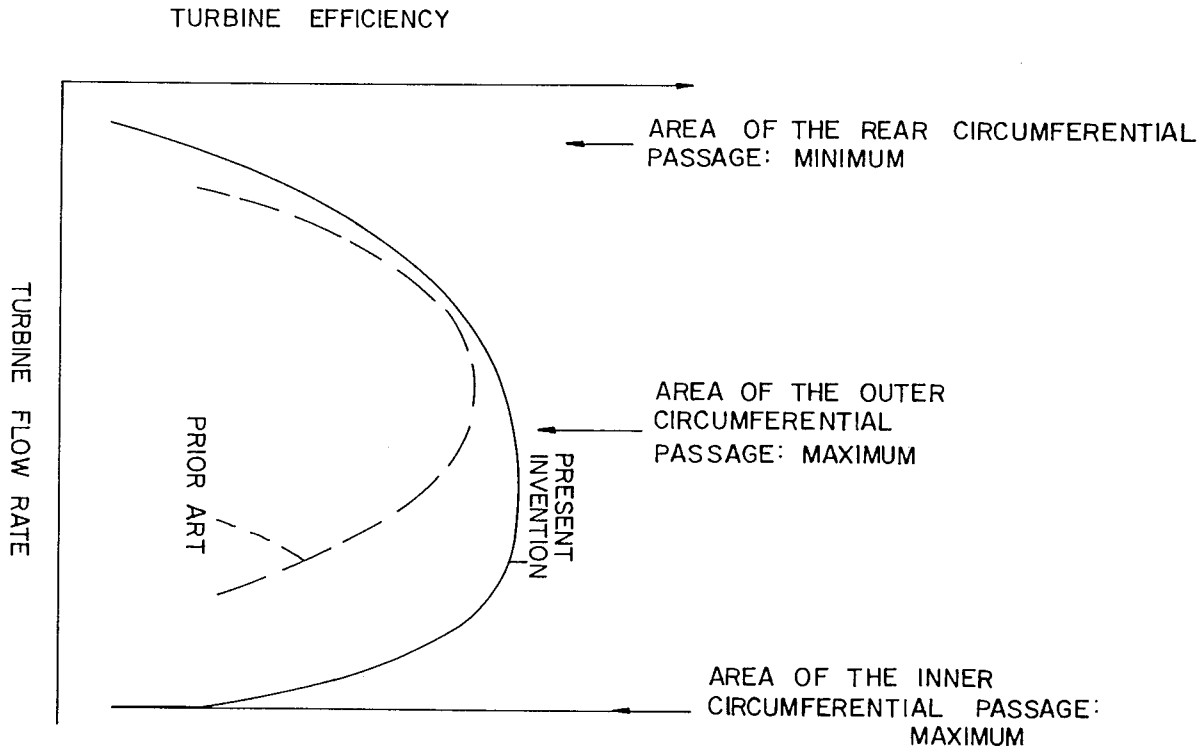
FIG. 7 is a graph showing the relationship between the turbine flow rate and the turbine efficiency of the aforesaid second embodiment and that of the conventional prior art.

A second embodiment of the present invention will now be described with reference to the accompanying drawings shown in FIG. 4 (cross sectional view of a casing), FIG. 5 (cross sectional view taken along the line V—V in FIG. 4), and FIG. 6 (cross sectional view taken along the line VI—VI in FIG. 5) which show the structure. The comparison of the effect between the present invention and the prior art is shown in FIG. 7.

The gas flow introduced into the scroll 101 is then divided into an outer circumferential passage 105 which is formed by a front end 111 of the a front blade 110 having a supporting axis 113 in a rear end portion 112 of the front blade and a scroll inner wall 102 and an inner circumferential passage 108 which is formed by the front end 111 of the front blade and a tonque-shaped portion 107 of the scroll.

The gas which has passed through the outer circumferential passage 105 is then introduced into a scroll passage 103 through a rear variable passage 104 which is formed by a rear end 122 of a rear blade 120 having a supporting axis 123 in a front end portion 121 of the rear blade and the scroll inner wall 102. As shown in FIG. 4, the rounded upstream end 121 of the rear blade 120 forms a continuous wall with the rounded downstream end 112 of the front blade 110. The flow is then introduced into a rotating blade 130 through the inner portion of the scroll 101.

The gas which has passed through the inner circumferential passage 108 is then introduced into the rotating blade 130 through the passage which is formed by the inner side wall of the front blade 110 and the tongue-shaped portion 107.

By turning a lever 114 fixed to a portion of the front blade 110 extending through an opening 115 in the scroll 101, the front blade 110 is rotated relative to the supporting axis 113 and the inner passage 108 is expanded, whereby the flow rate of the turbine increases.

At this time, although the area of the outer circumferential passage 105 becomes smaller, the distance between the front blade 110 and the scroll inner wall 102 is wide enough to prevent the interference of the gas flowing into the outer circumferential passage 105.

If the flow rate is intended to become smaller, the front blade 110 is brought into the position near the scroll tongue shaped portion 107, and a lever 124 attached to a portion of the rear blade 120 extending through an opening 125 in the scroll 101 is rotated to bring the rear end 122 of the rear blade 120 into the position near the scroll inner wall 102.

Figure 14:
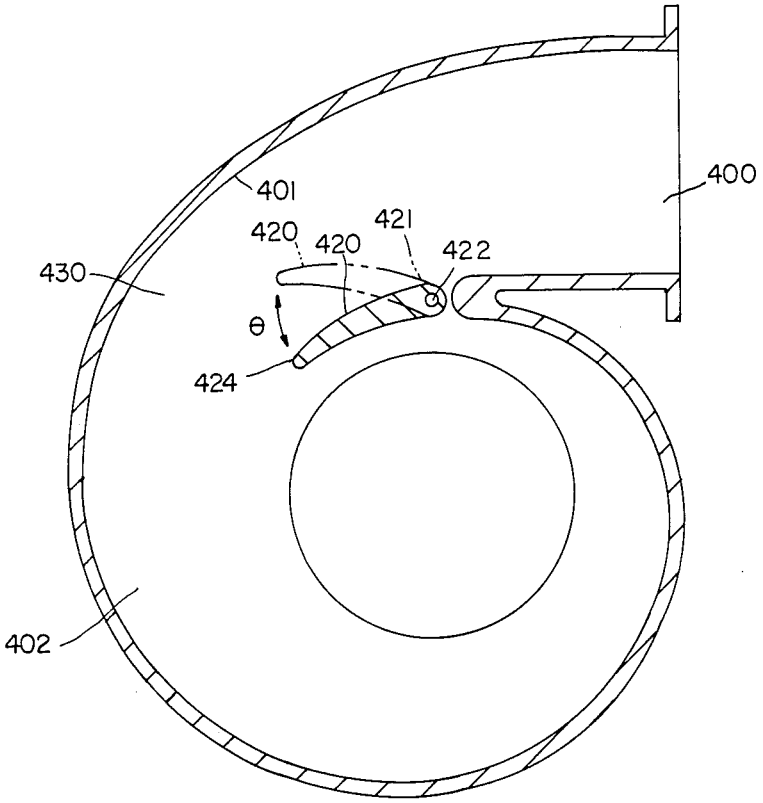
FIG.14 PRIOR ART
FIG. 14 is a lateral cross sectional view of another conventional example.
Figure 15:
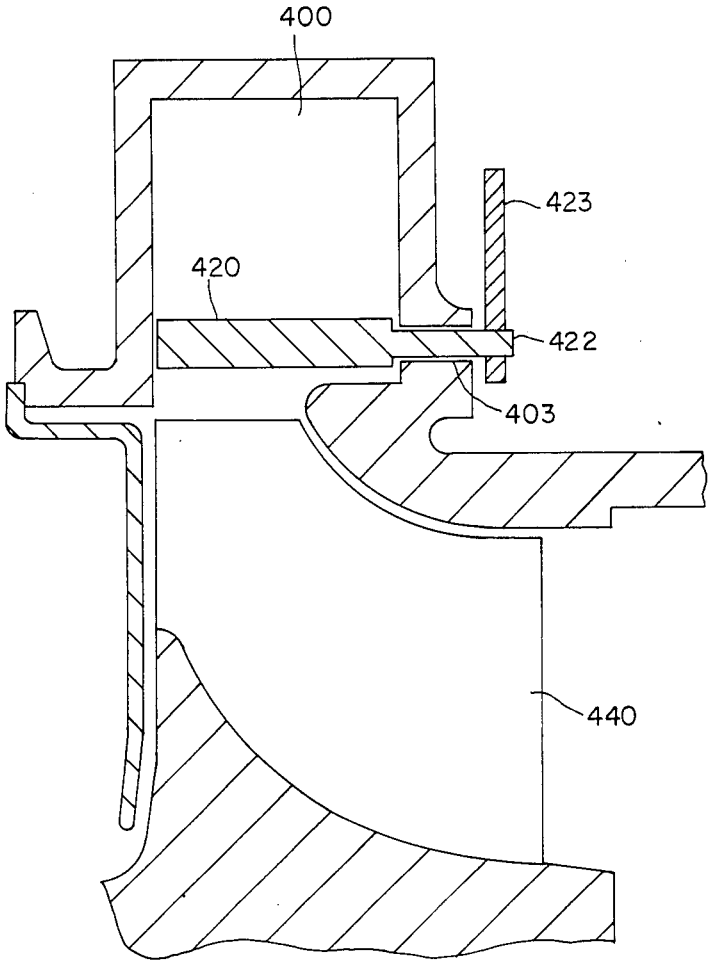
FIG.15 PRIOR ART
FIG. 15 is a vertical cross sectional view of the same.

FIG. 7 illustrates the relationship between the turbine flow rate and the turbine efficiency of the device according to the present invention and the conventional device shown in FIG. 14 and 15. As can be clearly seen from this drawing, the turbine efficiency is remarkably improved.

Figure 8:
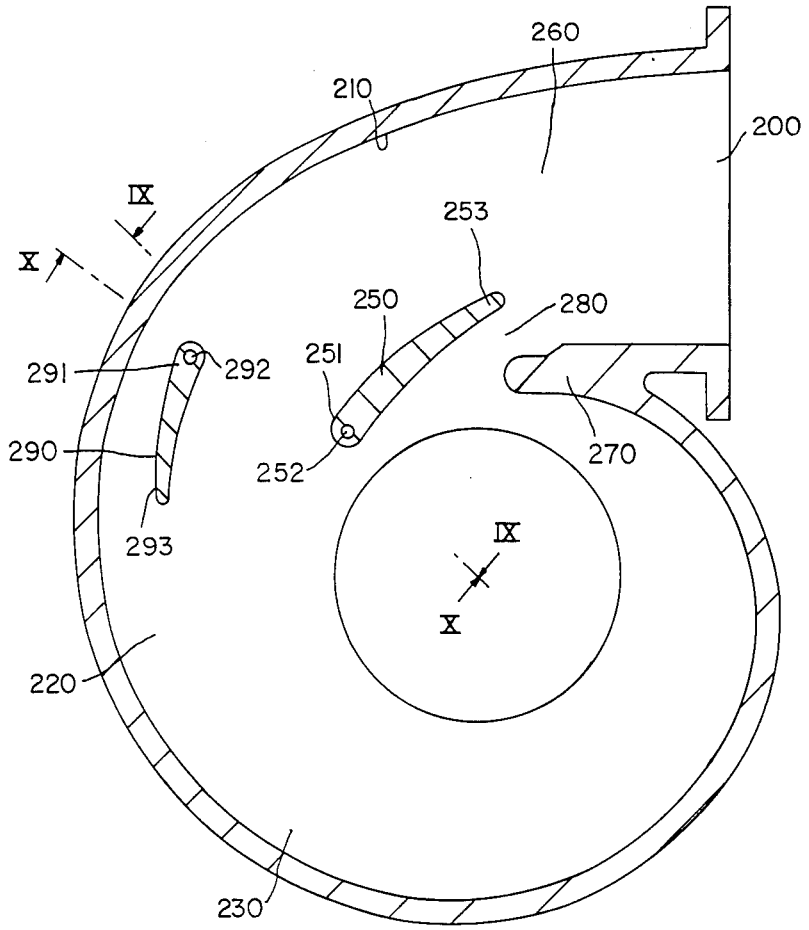
FIG. 8 is a cross sectional view of a third embodiment of the present invention.
Figure 9:
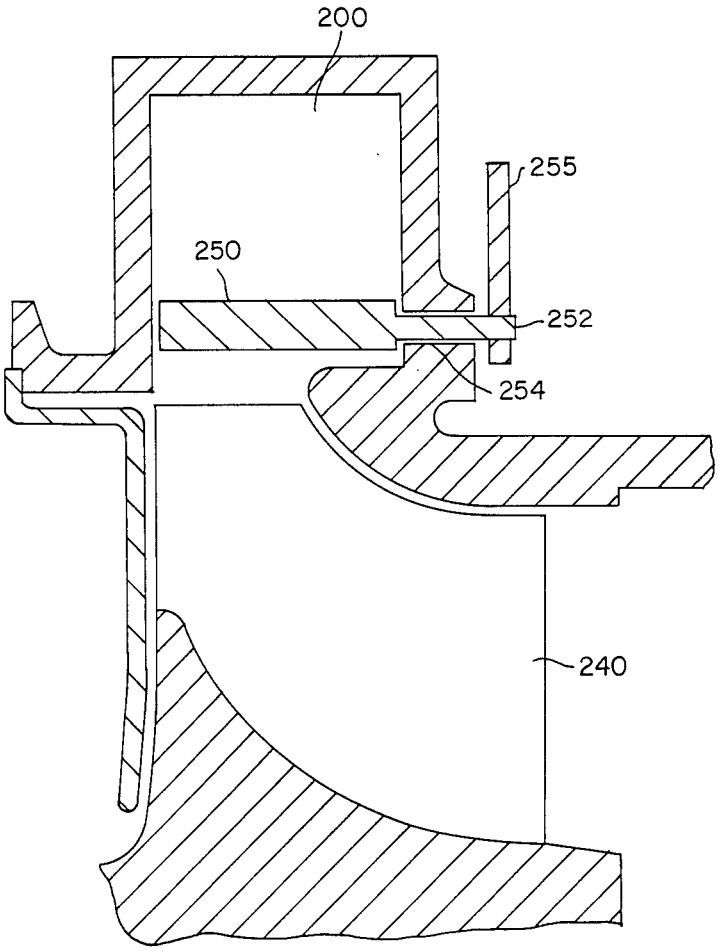
FIG. 9 is a cross sectional view taken along the line IX—IX in FIG. 8.
Figure 10:
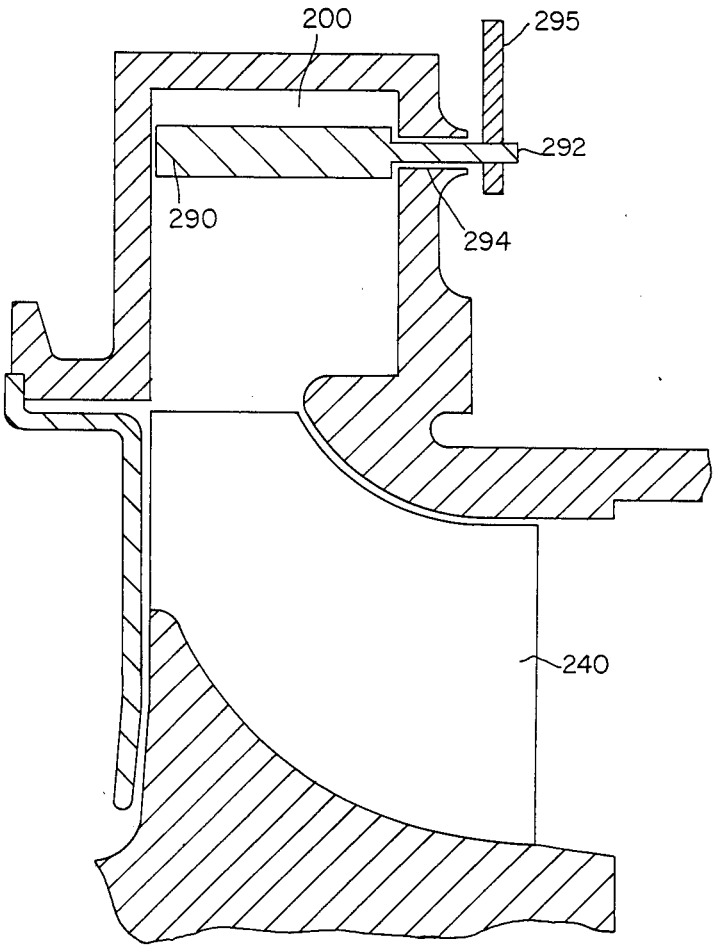
FIG. 10 is a cross sectional view taken along the line X—X in FIG. 8.
Figure 11:
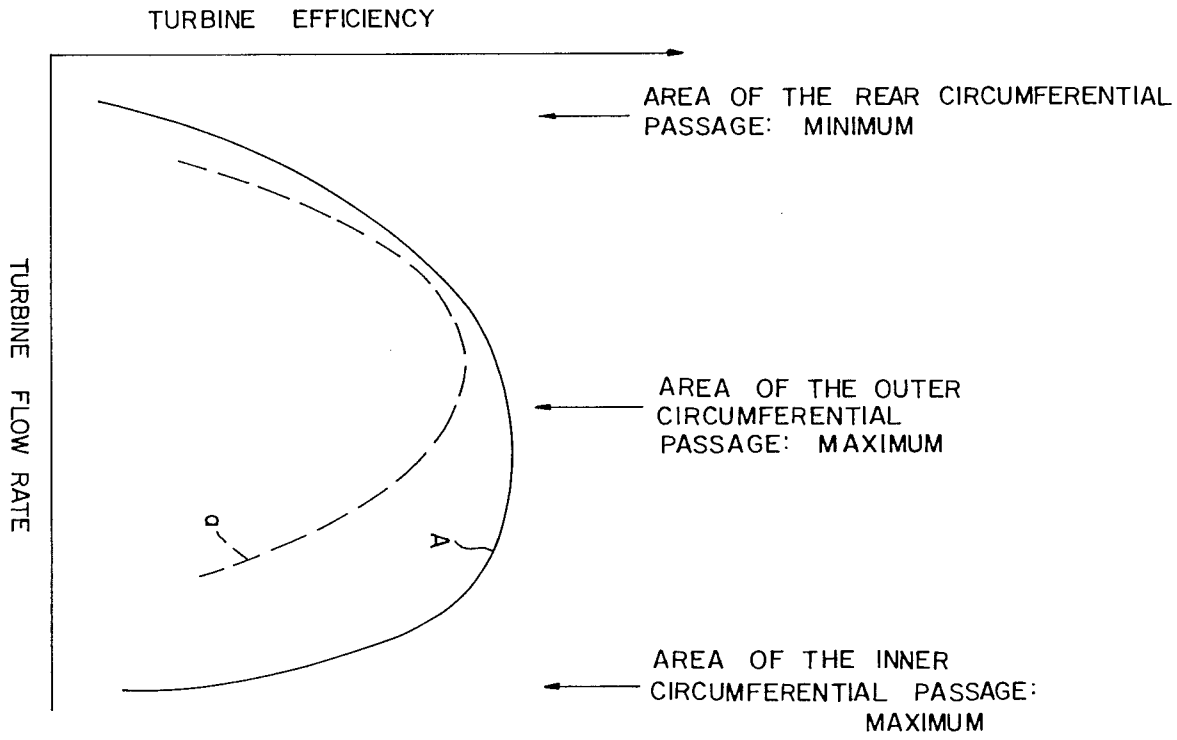
FIG. 11 is a graph showing the relationship between the turbine flow rate and the turbine efficiency of the aforesaid third embodiment and that of the conventional prior art.
Figure 12:
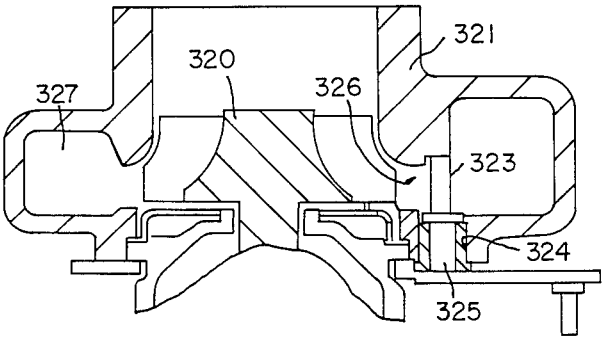
FIG. 12 PRIOR ART
FIG. 12 is a lateral cross sectional view of the conventional example.
Figure 13:
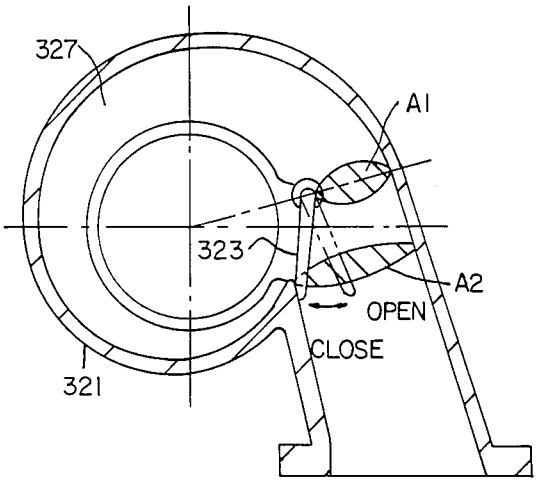
FIG. 13 PRIOR ART
FIG. 13 is a vertical cross sectional view of the same.

A third embodiment of a variable inlet port type radial turbine according to the present invention will now be described. FIG. 8 is a cross sectional view illustrating it from which the rotating blade is omitted. FIG. 9 is a partial cross sectional view taken along the line IX—IX in FIG. 8. FIG. 10 is a partial cross sectional view taken along the line X—X in FIG. 8. FIG. 11 is a graph showing the turbine efficiency in comparison with that of the conventional type turbine.

This radial turbine forms a turbocharger with a compressor. It comprises, as shown in FIGS. 8 to 10, a rotating blade 240 on the inside thereof and a scroll passage 200 which supplies a gas to this moving blade 240. In the area adjacent to the inner circumference near the entrance of the scroll passage 200, a first pivotable blade 250 is provided. In the area adjacent to the outer circumference of the scroll passage downstream of this first movable blade 250, a second pivotable blade 290 is provided.

The first pivotable blade 250 has a rotational shaft 252 in the portion 251 adjacent to the rear end (read end portion) with respect to the blade center. The second pivotable blade 290 has a rotational shaft 292 in the portion 291 adjacent to the front end (front end portion) with respect to the center of the blade.

The rotational shaft 252 penetrates into a hole 254 which is formed in the turbine casing. A lever 255 is secured to the end portion of the rotational shaft 252. The first pivotable blade 250 can be therefore rotated relative to the axis of the rotational shaft 252 by rotating the lever 255. Such rotation of the first pivotable blade 250 causes an outer circumferential passage 260 to be formed by the first pivotable blade 250 and a scroll passage inner wall 210 and an inner circumferential passage 280 is formed between the first pivotable blade 250 and a scroll tongue-shaped portion 270.

The rotational shaft 292 penetrates into a hole 294 which is formed in the turbine casing. A lever 295 is secured to the end portion of the rotational shaft 292. Therefore, by turning this lever 295, the second pivotable blade 290 can therefore be rotated relative to the axis of the rotational shaft 292. The rotation of the second pivotable blade 290 causes the state of a rear variable passage 220 which is formed by the second pivotable blade 290 and the scroll passage inner wall 210 to be changed.

In FIG. 8, reference numeral 253 represents a front end portion of the first pivotable blade 250, reference numeral 293 represents a rear end portion of the second pivotable blade 290, and reference numeral 230 represents a rear scroll passage.

As mentioned above, in the case where the flow rate is intended to be increased, first the rotational shaft 252 is rotated counterclockwise in FIG. 8. The gas (fluid) which has been introduced into the scroll passage 200 is divided into the outer circumferential passage 260 which is formed between the front end portion 253 of the first pivotable blade 250 and the scroll passage inner wall 210 and the inner circumferential passage 280 which is formed between the first pivotable blade 250 and the scroll passage tongue-shaped portion 270.

The fluid which has passed through the outer circumferential passage 260 passes through the rear variable passage 220 which is formed by the second pivotable blade 290 which is disposed downstream and the scroll passage inner wall 210 and then introduced into the rear scroll passage 230 and introduced into the rotating blade 240 through an opening in the inside of the scroll passage 200.

The fluid which has passed through the inner circumferential passage 280 bypasses the passage which is formed between the first pivotable blade 250 and the scroll passage inner wall 210 and is introduced into the rotating blade 240.

By further counterclockwise rotation of the first pivotable blade 250 relative to the axis of the rotational shaft 252, the inner circumferential passage 280 is expanded, whereby the turbine flow rate increases without any generation of the dead water region in the region of the downstream side of the blade.

In the case where the flow rate is intended to be reduced, the passage opening into the rotating blade 240 must be made narrower by rotation of the second pivotable blade 290 by means of the lever 295. Since the length of the pivotable blade 290 is shorter with respect to the conventional type shown in FIGS. 14 and 15, the dead water region in the downstream region of the blade is small. Furthermore, the blade 290 can direct the fluid into the inside portion of the passage, whereby the deterioration in efficiency can be kept small.

Since the flow from the pivotable blade 290 downstream to the scroll passage 200 does not exceed the rate when the downstream variable passage area is at a maximum, the scroll passage can be designed in accordance with the case in which the downstream variable passage area is maximum. Furthermore, since the rotational shaft 292 of the second pivotable blade 290 is disposed in the outer circumferential portion, the deterioration in turbine efficiency at the time when the flow rate is intended to be made smaller can be reduced with respect to that of the conventional prior art.

On the other hand, in case where the flow rate is intended to be increased, the deterioration in the turbine efficiency can be kept small because the inner circumferential passage 280 is opened, whereby high turbine efficiency can be obtained in a wide flow rate range. FIG. 11 is a graph showing the relationship between the turbine flow rate and the turbine efficiency of the present invention compared with the conventional type turbine. In FIG. 11, symbol A represents the characteristics of a variable inlet port type radial turbine according to this embodiment. Symbol "a" represents the characteristics of the conventional variable inlet port type radial turbine shown in FIGS. 14 and 15. The provision of two or more first pivotable blades 250 and the second pivotable blades 290 may be employed in this embodiment.

As described above, the present invention can display the following effects.

(1) Due to the provision of a plurality of movable vanes, the turbine capacity can be changed in a wide range.

(2) Due to the provision of a plurality of movable vanes and the resulting alignment of the flow direction of the exhaust gas and that of the pivotable vane at the time the pivotable vane is opened, high turbine efficiency can be achieved.

Further, according to the present invention, since the flow rate, exceeding the rate when the outside variable passage area is maximum, does not pass downstream from the pivotable vane to the scroll passage, the scroll outside variable passage can be designed in accordance with the maximum area of the variable passage, whereby the deterioration in efficiency can be kept small in comparison to the conventional prior art when the flow rate is intended to be made smaller (the case where the outside variable passage area is made narrow), whereby high efficiency can be obtained in a wide range.

Also according to the present invention, in spite of the simple structure, the turbine efficiency can be improved by keeping the dead water region which is generated in the downstream region of the pivotable blade as small as possible.

While the present invention has been described with reference to the foregoing embodiments, various changes and modifications may be made thereto which fall within the scope of the appended claims.

What is claimed is:

1. A variable capacity radial flow turbine comprising:

a housing having therein a turbine wheel and a scroll-shaped passageway for passage of gas from an inlet of said housing to said turbine wheel;

means for adjusting the cross-sectional area of said passageway so that the flow rate of gas passing to said turbine wheel can be changed, said means comprising a plurality of pivotable blades pivotally mounted about respective pivot axes to said housing, a first one of said pivotable blades being located in said passage way upstream of a second one of said pivotable blades also located in said passageway, said first blade being pivotable from a closed position at which gas passes through said passageway only radially outwardly of said first blade to an open position at which gas passes through said passageway both radially inwardly and radially outwardly of said first blade, said second blade being pivotable in said passageway to vary the cross-sectional area of said passageway at a position downstream of said first blade.

2. The turbine of claim 1, wherein each of said blades is pivotably mounted to said housing by means of a rotatable shaft and a lever provided on the outside of said housing is connected to said rotatable shaft for rotation thereof, each of said blades being pivotable independently of the other ones of said blades.

3. The turbine of claim 1, wherein said second blade is pivotable from a position at which gas passes through said passageway only radially outwardly of said second blade to a position at which gas passes through said passageway both radially inwardly and radially outwardly of said second blade.

4. The turbine of claim 1, wherein said first blade is pivotally mounted to said housing at a downstream end of said first blade and said second blade is pivotally mounted to said housing at a downstream end of said second blade.

5. The turbine of claim 4, wherein said first blade and said second blade are pivotally mounted to said housing a respective positions located at a radially inner part of said passageway.

6. The turbine of claim 1, wherein said first blade is pivotally mounted to said housing at a radially inner part of said passageway and said second blade is pivotally mounted to said housing at a radially outer part of said passageway.

7. The turbine of claim 1, wherein said second blade is pivotally mounted to said housing at an upstream end of said second blade.

8. The turbine of claim 7, wherein said first blade and said second blade are pivotally mounted to said housing a respective positions located at a radially inner part of said passageway.

9. The turbine of claim 7, wherein said first blade is pivotally mounted to said housing at a radially inner part of said passageway and said second blade is pivotally mounted to said housing at a radially outer part of said passageway.

10. The turbine of claim 9, wherein said second blade includes an upstream end which forms a continuous wall with a downstream end of said first blade.

11. The turbine of claim 10, wherein said upstream end of said second blade is rounded in cross-section taken in a plane perpendicular to the pivot axis of said second blade and said downstream end of said first blade is rounded in cross-section taken in a plane perpendicular to the pivot axis of said first blade.

12. The turbine of claim 1, wherein said turbine includes a tongue-shaped portion which contacts an upstream portion of said first blade when said first blade is in said closed position.

13. The turbine of claim 1, wherein said pivot axes are parallel to each other.

14. A variable capacity radial flow turbine comprising:

a housing having therein a turbine wheel and a scroll-shaped passageway for passage of gas from an inlet of said housing to said turbine wheel;

means for adjusting the cross-sectional area of said passageway so that the flow rate of gas passing to said turbine wheel can be changed, said means comprising a plurality of pivotable blades pivotally mounted about respective pivot axes to said housing, a first one of said pivotable blades being located in said passageway upstream of a second one of said pivotable blades also located in said passageway, said first blade being pivotable from a closed position at which gas passes through said passageway only radially outwardly of said first blade toan open position at which gas passes through said passage way both radially inwardly and radially outwardly of said first blade, said second blade being pivotable in said passageway to vary the cross-sectional area of said passageway at a position downstream of said first blade, said first blade being pivotally mounted to said housing by means of a first shaft positioned at a downstream end of said first blade and said second blade being pivotally mounted to said housing by means of a second shaft positioned at an upstream end of said second blade.

15. A variable capacity radial flow turbine comprising:

a housing having therein a turbine wheel and a scroll-shaped passageway for passage of gas from an inlet of said housing to said turbine wheel;

means for adjusting the cross-sectional area of said passageway so that the flow rate of gas passing to said turbine wheel can be changed, said means comprising a plurality of pivotable blades pivotally mounted about respective pivot axes to said housing, a first one of said pivotable blades being located in said passageway upstream of a second one of said pivotable blades also located in said passageway, said first blade being movable from a closed position at which gas passes through said passageway only radially outwardly of said first blade to an open position at which gas passes through said passageway both radially inwardly and radially outwardly of said first blade, said second blade being pivotable in said passageway to vary the cross-sectional area of said passageway at a position downstream of said first blade, said first blade being pivotally mounted to said housing by means of a first shaft positioned at a downstream end of said first blade and said second blade being pivotally mounted to said housing by means of a second shaft positioned at an upstream end of said second blade, a cross-sectional area of said passageway adjacent to radially inner part thereof being adjusted by said first blade and a cross-sectional area of said passageway adjacent a radially outer part thereof being adjusted by said blade.

* * * * *